US009994287B1

(12) United States Patent
Mayers

(10) Patent No.: US 9,994,287 B1
(45) Date of Patent: Jun. 12, 2018

(54) ROTATING MAST SYSTEM FOR SAILBOAT

(71) Applicant: Tom W. Mayers, Longboat Key, FL (US)

(72) Inventor: Tom W. Mayers, Longboat Key, FL (US)

(73) Assignee: Joan Bergstrom, LongBoat Key, FL (US)

( * ) Notice: Subject to any disclaimer, the term of this patent is extended or adjusted under 35 U.S.C. 154(b) by 0 days. days.

(21) Appl. No.: 15/530,539

(22) Filed: Jan. 27, 2017

(51) Int. Cl.
*B63B 15/00* (2006.01)
*B63H 9/06* (2006.01)
*B63B 35/00* (2006.01)

(52) U.S. Cl.
CPC .... *B63B 15/0083* (2013.01); *B63B 2015/005* (2013.01); *B63B 2035/009* (2013.01); *B63H 9/06* (2013.01)

(58) Field of Classification Search
CPC ..... B63B 35/00; B63B 35/73; B63B 35/79; B63H 9/00; B63H 9/06; B63H 9/04; B63H 9/10
USPC ..... 114/90, 91
See application file for complete search history.

(56) References Cited

U.S. PATENT DOCUMENTS 4,697,534 A * 10/1987 Kettlestrings ..... B63B 35/7959 114/90
4,774,901 A * 10/1988 Baldwin ..... B63B 35/7959 114/91

* cited by examiner

*Primary Examiner* — Lars A Olson
(74) *Attorney, Agent, or Firm* — William E. Mouzavires

(57) ABSTRACT

A rotatable mast system for a sailing craft wherein a lower section of the mast is mounted for rotation in upper and lower bearings fixed to the body of the sailing craft spaced along the length of the lower mast section. The upper section of the mast is removable from the lower section for purposes of servicing, repairing or replacing the upper section of the mast. The lower section of the mast remains in the sailing craft for future use and does not have to be removed while the upper mast section is removed for servicing, repair or replacement, etc. However if desired, the lower mast section may be removed by itself or with the upper section. The lower section of the mast may be made from aluminum and it also includes attachments for connecting a boom and the rigging to the lower section of the mast.

16 Claims, 4 Drawing Sheets

ROTATING MAST SYSTEM FOR SAILBOAT

BACKGROUND OF INVENTION

The present invention generally relates to sailboats and other sailing craft and more specifically to a novel and improved rotating mast system for a sailboat. The use of rotating masts to position the sail or sails of a sailing craft is now well known. However because the mast is rotatable, the weight of the mast can at times cause problems with respect to its rotatability as well as its mounting to the sailing craft body. This is due to the weight of the mast and the forces imposed on the mast during sailing. The above conditions can cause the mast to bind in its bearings to impair rotation of the mast and to cause undue wear on the bearings.

SUMMARY OF PREFERRED EMBODIMENT OF THE PRESENT INVENTION

An object of the present invention is to overcome, if not significantly reduce the above-noted problems through the use of a novel and improved rotating mast system. One preferred embodiment of the present invention includes a mast which includes two sections, one section being a lower base or foundational section and an upper super structure section mounted on the lower base section. In this embodiment the lower base section includes a cylindrical tube mounted on a lower section of a sailing craft or boat body, such as at the step, through a bearing fixed at the step. Another bearing is fixed above the step to the body of the craft and receives an upper part of the base section. The height of the base section preferably extends to the area of the level of the boom or the booms of the boat so that the booms and their rigging cables can be attached to the base section level.

BRIEF DESCRIPTION OF THE DRAWINGS

Other objects and advantages of the present invention will become apparent from the following detailed description taken in conjunction with the attached drawings in which.

DETAILED DESCRIPTION

Figure 1:
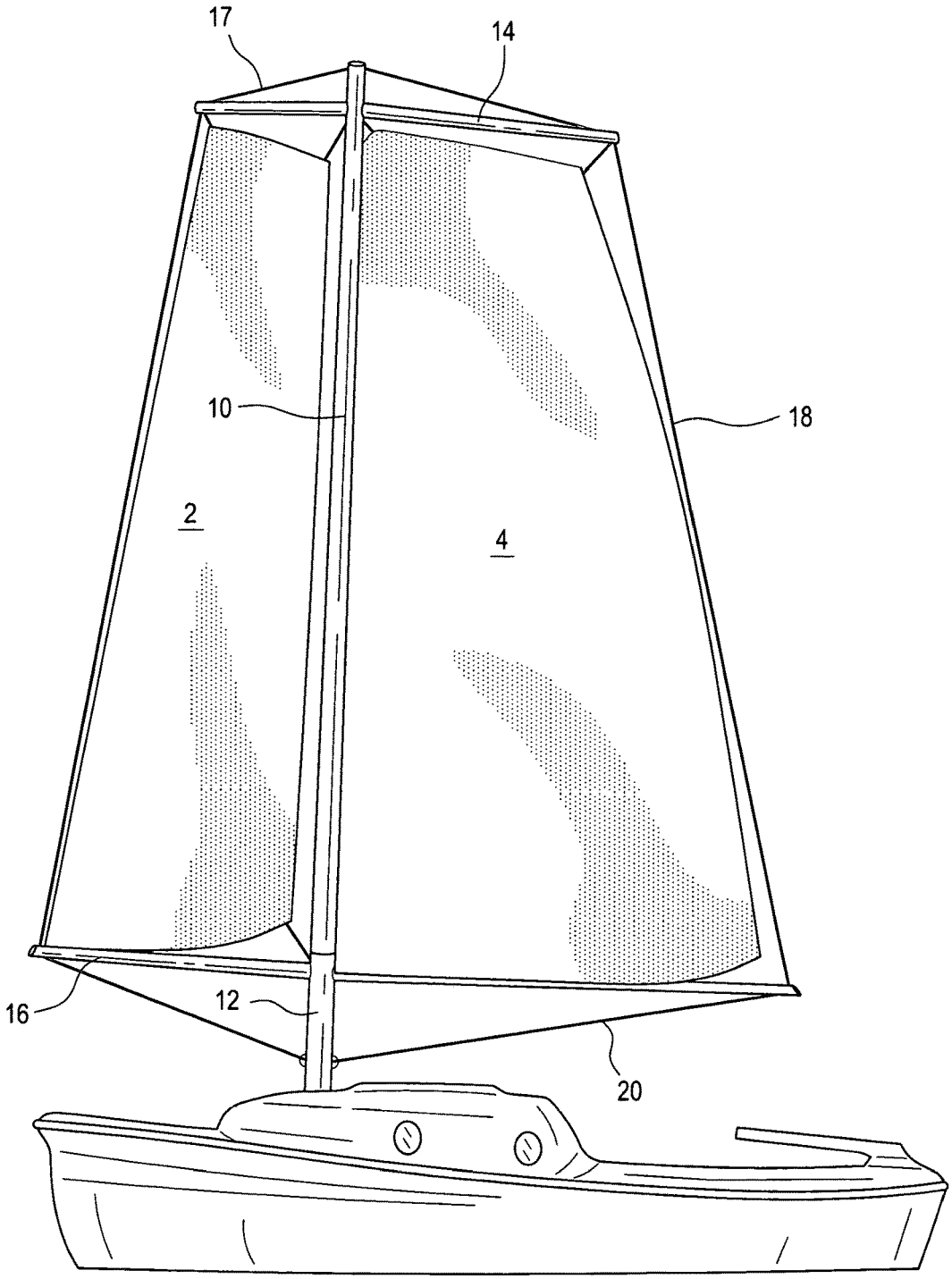
FIG. 1 is a perspective view of a sailboat incorporating one preferred embodiment of the rotating mast system of the present invention.

Referring now to the drawings in details there is shown for illustrative purposes only in FIG. 1 a sailboat incorporating a preferred embodiment of the rotating mast system of the present invention. The sailboat includes fore and aft sails 2 and 4 supported by the the mast system including a mast provided in two sections including an upper or main section 10 and a lower or base section 12 which is mounted on the body or hull of the boat for rotation. Upper and lower spars or booms 14 and 16 are connected to the upper and lower mast sections 10 and 12 respectively as shown in FIG. 1. The mast and booms are rigged with cables or wire 17, 18, and 20 connected to the mast sections 10 and 12 as shown in FIG. 1.

Figure 2:
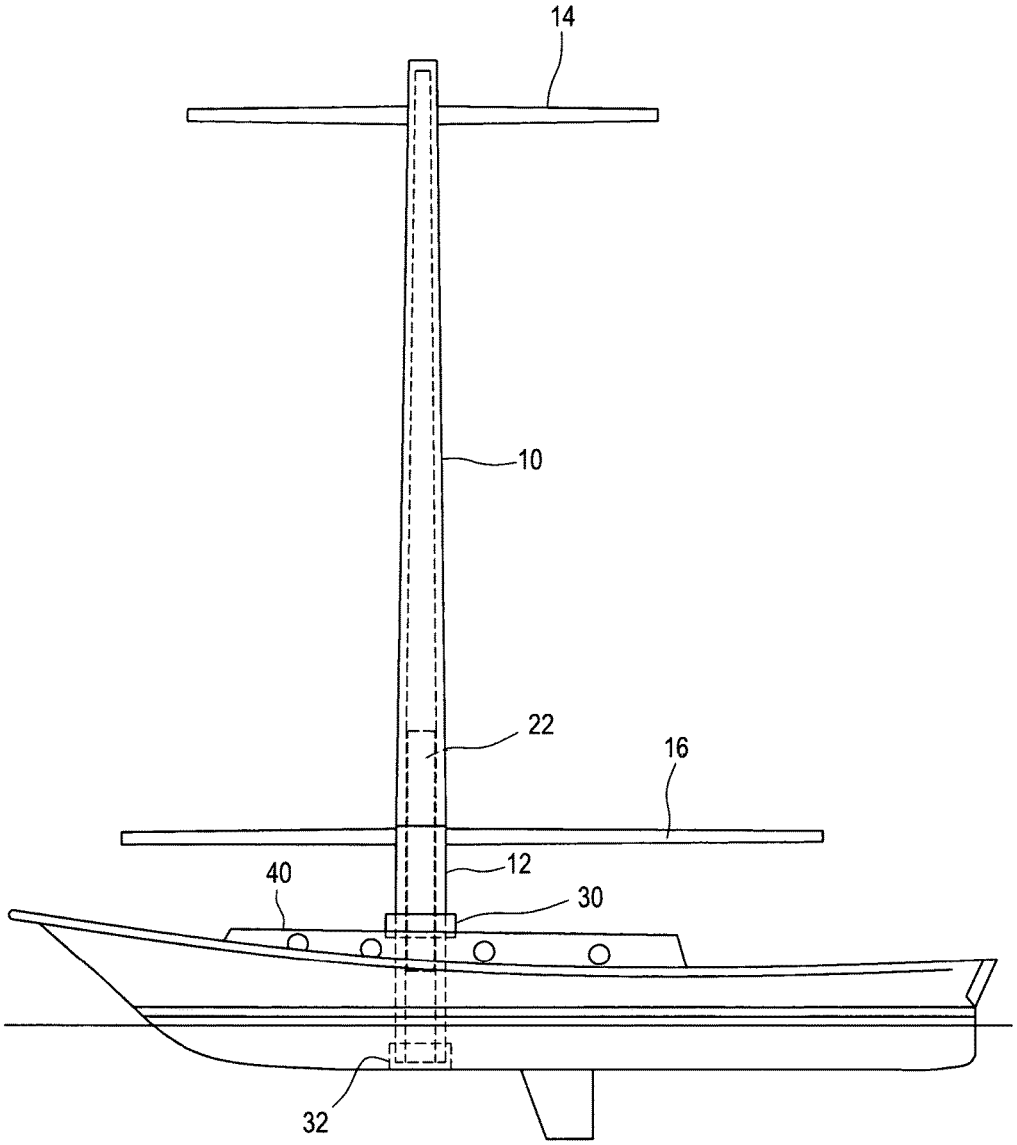
FIG. 2 is a side elevational view in cross-section of the mast system of the present invention as incorporated in the sailboat but with the sails omitted.

The upper mast section 10 can be made from any suitable material including wood, carbon fiber or aluminum, however it is preferred that the lower mast section 12 be made from aluminum although the aforementioned materials may also be used. The upper and lower mast sections 10 and 12 are interconnected in any suitable manner, however in one preferred embodiment a plug 22 is used as shown in FIG. 2. Plug 22 is inserted in the hollow of the mast sections 10 and 12 and bolted or otherwise fixed to both of these sections. In the shown embodiment plug 22 is preferably made of carbon fiber although in other embodiments the plug could be formed integral with one of the mast sections and then fixed to the other mast section such as, for example, by bolts. If it is necessary to remove or replace the upper mast section 10, the plug 22 is simply unbolted from the lower mast section 12 which remains in place and does not need to be detached from the craft.

Figure 3:
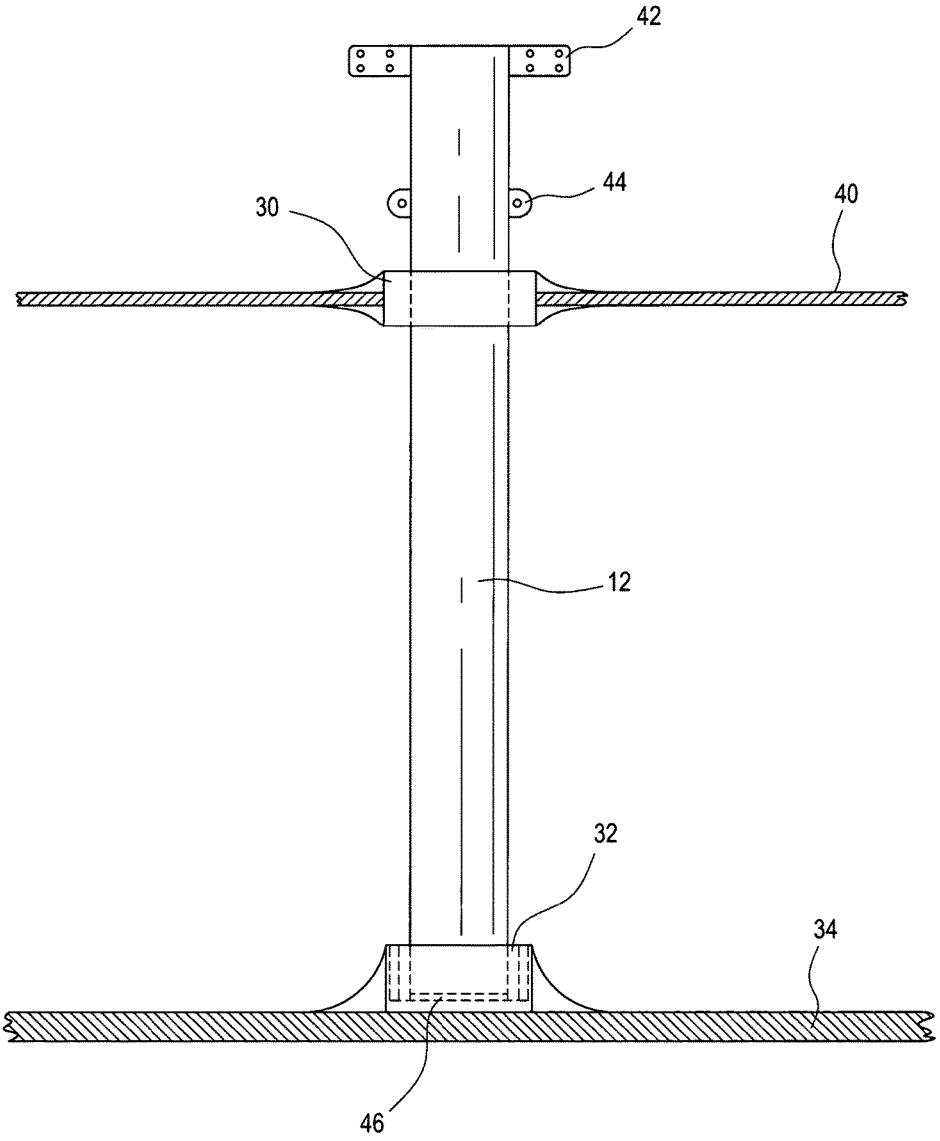
FIG. 3 is a fragmental, elevational view of a base section of the mast system.
Figure 4:
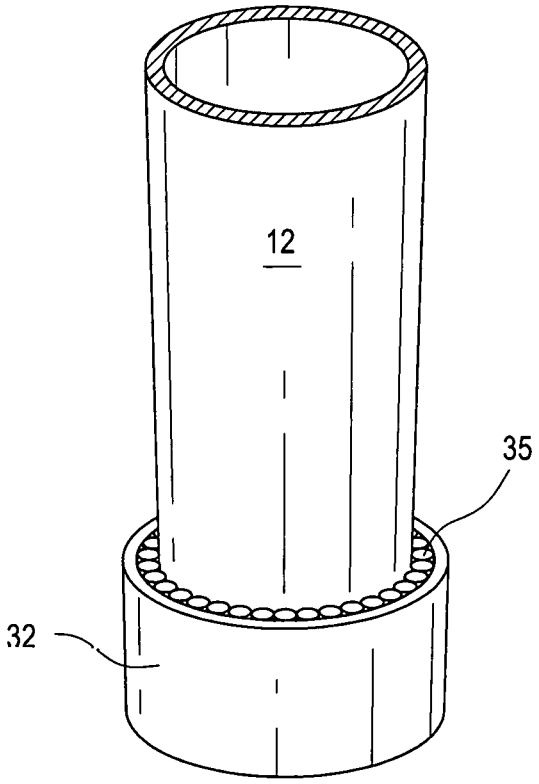
FIG. 4 is a perspective view of the base section shown together with one of its bearings but with certain parts removed.

Referring to FIGS. 2 and 3, the lower section 12 of the mast is mounted for rotation in bearings 30 and 32. The upper bearing 30 is fixed to an upper section of the boat shown in the specific embodiment as the top wall 40 of the cabin shown in FIGS. 2 and 3. The lower bearing 32 is fixed at the step at the base 34 of the hull as shown in FIG. 3. The lower bearing 32 is also shown in FIG. 4 and includes nylon or other low friction rods 34 as the bearings between the body of the bearing and the lower mast section 12. As shown in FIG. 3, the length of the lower section 12 of the mast is sufficient to position its upper end in the area of the lower boom 16 so that the lower boom may be attached to the lower mast section 12 through straps or flanges 42 bolted to the lower mast section 12. Of course any other method may be used to attach the lower boom 16 to the mast section 12. The base section 12 of the mast is also provided with eyelets 44 shown in FIG. 3 for attaching or connecting the rigging cable 20 as shown for example in FIG. 1.

In the preferred embodiment, eyelets 44 and straps 42 shown in FIG. 3 may be made from aluminum and welded to lower mast section 12. Any other suitable construction can be used as will be apparent to one of ordinary skill in the art. Additionally in the preferred embodiment, the bottom of lower mast section 12 is provided with a low friction molecular material shown at 46 in FIG. 3.

As will be seen from the above description, the dual bearings and separate base section of the mast used together with the dual bearings provide an improved foundation for the mast and yet will permit the desired rotation of the mast. In addition the present invention allows the upper mast section 10 to be removed and serviced, replaced or repaired and then returned to the lower mast section 12 which shall remain in the boat or watercraft while the upper section 10 is removed. The above construction also makes it easier and more practical to work on and store the mast parts. If desired, the lower mast section 12 may be removed from its bearings by itself or together with the upper section 10.

It will also become apparent that although one particular sailboat has been shown in FIG. 1 for illustrative purposes only, the improved mast assembly or system may be applied to virtually all types of sailboats or sailing craft which require a rotatable mast. Therefore while a specific embodiment of the present invention has been shown and described above for illustrative purposes, it will be understood that other variations of the mast system of the present invention will become apparent to those of ordinary skill in the art but without departing from the scope of the present invention indicated in the attached claims to follow.

What is claimed is:

1. A rotatable mast system for a sailing craft including upper and lower mast sections mounted for rotation in the body of a sailing craft, upper and lower bearings for rotatably mounting the lower section of the mast to the body of a sailing craft at locations spaced along the length of the lower section of the mast, and means for releasably interconnecting the lower and upper mast sections to allow the upper section of the mast to be removed from the lower section of the mast while retaining the lower section of the mast in the sailing craft, said means includes a plug received in the upper and lower mast sections.

2. The system defined in claim 1 wherein the lower section of the mast includes means for connecting a boom and rigging cable to the lower section of the mast including a fixture on said lower section of the mast to be attached to said boom and rigging cable.

3. The system defined in claim 2 wherein the lower section of the mast is made from aluminum tubing, and said upper section of the mast is made from carbon fiber.

4. The system defined in claim 1 wherein said plug is received in hollow passages of the mast sections.

5. A sailing craft comprising in combination:

a body including upper and lower decks vertically spaced from each other, a mast assembly mounted for rotation in said decks including upper and lower mast sections interconnected to each other, a first bearing fixed to said lower deck, and rotatably receiving the lower mast section for rotation, and a second bearing fixed to said upper deck and rotatably receiving the lower mast section, means for releasably fixing the upper and lower mast sections together as a unit but allowing the upper mast section to be removed from the lower mast section while maintaining the lower mast section in said first bearing, a boom attached to the lower mast section, and a rigging line attached to the upper and lower sections of the mast and said boom.

6. The sailing craft defined in claim 5 further including a fixture on said lower section of the mast and a rigging line attached to said fixture.

7. The sailing craft defined in claim 5 wherein said means connecting said upper and lower mast sections includes a plug received in the upper and lower mast sections.

8. A method of constructing and installing a rotatable mast in a sailing craft including the steps of:

installing a bearing in the craft for mounting a mast in the craft for rotation about a vertical axis, providing a mast having upper and lower aligned sections that are separable from each other, and mounting the mast sections to the craft by inserting the lower mast section in said bearing for rotation about the vertical axis, and wherein said upper section is removable from said lower section while the lower mast section remains in the bearing, installing a second bearing in the craft vertically aligned above said first bearing and receiving said lower section of the mast, attaching a boom to said lower mast section, and fastening a rigging line to the upper and lower sections of the mast and said boom.

9. The method defined in claim 8 including the step of fastening the rigging line to a fixture on the lower section of the mast.

10. The method defined in claim 8 including the step of installing said second bearing in a deck located on a cabin of the craft.

11. The method defined in claim 8 including the step of attaching the boom to a flange fixed to said lower mast section.

12. The craft defined in claim 5 including a flange on said lower section of the mast, and said boom is attached to said flange.

13. The craft defined in claim 5 wherein said lower mast section has an eyelet and said rigging line is attached to the eyelet.

14. The craft defined in claim 5 wherein said first bearing includes a body and means for reducing friction engaged between said lower mast section and said bearing body.

15. The craft defined in claim 14 wherein said means for reducing friction are rods.

16. A sailing craft comprising in combination:

a body including a first bearing, a rotatable mast including upper and lower sections separable from each other with the lower mast section received in said first bearing for rotation about a vertical axis, said body including a second bearing vertically aligned above said first bearing and receiving said lower mast section for rotation, a boom attached to said lower mast section, a rigging line connected to and extending between the upper and lower mast sections and the boom, and wherein said upper mast section may be removed from the lower mast while maintaining said lower mast section in said first bearing.

* * * * *